US005512798A

United States Patent [19]

Honda

[11] Patent Number: 5,512,798

[45] Date of Patent: Apr. 30, 1996

[54] LOW-PRESSURE MERCURY VAPOR DISCHARGE LAMP AND ILLUMINATING APPARATUS UTILIZING SAME

[75] Inventor: Hisashi Honda, Yokosuka, Japan

[73] Assignee: Toshiba Lighting & Technology Corporation, Tokyo, Japan

[21] Appl. No.: 317,590

[22] Filed: Sep. 30, 1994

[30] Foreign Application Priority Data

| | | | |
|---|---|---|---|
| Sep. 30, 1993 | [JP] | Japan | 5-244897 |
| Mar. 31, 1994 | [JP] | Japan | 6-062309 |
| Mar. 31, 1994 | [JP] | Japan | 6-064022 |

[51] Int. Cl.[6] ..... HO1J 1/62; HO1J 17/16

[52] U.S. Cl. ..... 313/489; 313/483; 313/485; 313/635

[58] Field of Search ..... 313/489, 483, 313/485, 635

[56] References Cited

U.S. PATENT DOCUMENTS

| | | | |
|---|---|---|---|
| 5,227,693 | 7/1993 | Sakakibara | 313/489 |
| 5,258,689 | 11/1993 | Jansma | 313/489 |

FOREIGN PATENT DOCUMENTS

| | | |
|---|---|---|
| 0001057 | 1/1980 | Japan . |
| 0133652 | 12/1983 | Japan . |
| 0018560 | 1/1984 | Japan . |
| 0298639 | 12/1989 | Japan . |
| 0294245 | 4/1990 | Japan . |

*Primary Examiner*—Sandra L. O'Shea
*Assistant Examiner*—John Ning
*Attorney, Agent, or Firm*—Oblon, Spivak, McClelland, Maier & Neustadt

[57] ABSTRACT

A low-pressure mercury vapor discharge lamp includes a light-transmitting tube containing discharge medium, a pair of discharge electrodes each mounted in a vicinity of respective end portions of the tube, a transparent conductive film formed of metallic oxide as a main component thereof and coated on an inner surface of the light-transmitting tube between the discharge electrodes, and the transparent conductive film having a thickness on one end portion of the tube relatively thinner than a thickness of the transparent conductive film on the other end portion of the tube. A phosphor film is coated on an inside surface of the transparent conductive film on an inside surface of the tube. The discharge lamp has a feature reduced in blackening on the transparent conductive film. A portion more capable of decreasing ultraviolet causing electrical resistance to change, such as the thick portion of the phosphor film and/or an ultraviolet decreasing film, is coated to the inside surface of the conductive film where the stability of the resistance relatively low, specifically the thick portion of conductive film in which more undecomposed material remains. The change in the resistance of the conductive film is balanced between both ends of the lamp bulb.

16 Claims, 6 Drawing Sheets

LOW-PRESSURE MERCURY VAPOR DISCHARGE LAMP AND ILLUMINATING APPARATUS UTILIZING SAME

BACKGROUND OF THE INVENTION

1. Field of The Invention

The present invention relates to a discharge lamp particularly of low-pressure mercury vapor typically represented by a fluorescent lamp having transparent conductive film coated on the inner surface of the lamp bulb and and also relates to an illuminating apparatus utilizing the same.

2. Description of The Related Arts

A low-pressure mercury vapor discharge lamp typically represented by a fluorescent lamp, such as a rapid-start type fluorescent lamp, has a bulb having an inner surface on which a transparent conductive film having tin oxide is formed as a main component thereof.

The formation of the transparent conductive film of tin oxide is performed, for example, by a spray method in which a tin chloride solution is sprayed or by a so-called CVD method in which vapor of tin oxide is sprayed on the inner surface of the bulb.

Since such a fluorescent lamp offers an excellent starting characteristic and needs no starter lamp, it is widely used in offices, department stores and the like. The rapid-start type fluorescent lamp, however, tends to suffer from yellowish-brown band deposits (hereinafter referred to as "yellowing") and blackening caused on the bulb inner surface in the vicinity of electrodes, for example portions apart from the electrodes by 10 to 30 cm, when it is used for a long time such as about more than 1000 hours. Fluorescent lamps that have no transparent conductive film suffers blackening as well. In this type fluorescent lamp, during the use thereof, electrode materials are sputtered and stuck onto a phosphor film where they react with mercury or phosphor, subsequently leading to blackening. In the rapid-start type fluorescent lamps, however, the yellowing and blackening in the vicinity of the electrodes are attributed to reasons other than the sputtering of electrode materials.

Many papers or publications are known that have analyzed the cause for yellowing and blackening typical of the rapid-start type fluorescent lamps. According to them, why yellowing and blackening take place is roughly summarized as follows. That is, a fluorescent lamp lights on AC supply, microscopic discharges takes place between the transparent conductive film, and electrodes at the moment the polarity is reversed. The microscopic discharges cause the transparent conductive film to change in quality. Mercury stuck onto the phosphor film coating near the electrodes forms a discharge path. Thus, phosphor coating to which mercury sticks is damaged by high energy of the discharge, the phosphor film coating itself reacts with mercury, and furthermore, mercury reacts with the transparent conductive film.

To restrict the generation of the yellowing and blackening phenomenon, microscopic discharge likely to cause them must be controlled. A method known to control the discharge is that the electrical resistance of the transparent conductive film is set higher near the electrodes, as disclosed, for example, in Japanese Patent Application Laid-open No. 56-84861.

More concretely, in the above prior art document of No. 56-84861, there is disclosed a technique for changing a resistance distribution of a transparent conductive film, in which a resistance at a bulb central portion per unit length in the bulb axial direction is made low and a resistance at bulb end portions near the electrodes is made high to obtain substantially V-shaped resistance distribution of the conductive film between the electrodes of the lamp to thereby suppress a minute discharge near the electrodes. Such technique has been applied to commercially sold rapid-start type fluorescent lamps, in which a resistance at the central portion of the bulb is about 2 kΩ to 50 kΩ per 10 cm along the axial length thereof and is about 20 kΩ to 500 kΩ per 10 cm along the axial length thereof. In such fluorescent lamps, in order to obtain the V-shaped resistance distribution, the film thickness of the conductive film is changed on the inner surface of the bulb. In the disclosed example, the conductive film is formed by introducing vapor of tin compound and reacted therein so as to deposit the tin oxide on the inner surface of the bulb. In this operation, since a reaction speed is changed in an exponential function with respect to a bulb temperature, the thickness of the conductive film is increased by making high the temperature at the central portion of the bulb.

However, in the conventional technology, since the bulb temperature is made high to supply the tin compound vapor by an amount more than required, the reaction of the conductive film and the production speed thereof are made faster, but an un-reacted tin compound remains, making coarse the film condition. Such un-reacted tin compound is gradually reacted during the lighting. It is also found that, due to the reaction after depositing of the film, the film provides a large gap ratio and less elaboration in density, and accordingly, the thickness of the film is made thick even in the same deposited amount and the same resistance. Moreover, since the undecomposed tin compound is reacted and decomposed during the lighting of a fluorescent lamp, as a product, the resistance of the transparent conductive film is gradually lowered during the use of the fluorescent lamp and, hence, angle of the V-shaped resistance distribution is widened, thus liably causing the blackening phenomenon to the lamp. Furthermore, there causes a case where impure gas is produced through the decomposing reaction of the tin compound, damaging the startability of the fluorescent lamp.

In another method such as disclosed in Japanese Patent Application Laid-open No. 57-32561, there is shown a technique for stabilizing the resistance distribution of the transparent conductive film by adding an additive such as antimony to the conductive film. In this technique, however, it is intended to stabilize the resistance distribution only at the production starting time, and accordingly, it is difficult to obtain a proper resistance distribution of V-shape by adding the antimony.

A further method is that an electrically insulating film is coated on the transparent conductive film, as disclosed, for example, in Japanese Patent Application Laid-open No. 50-12885, Japanese Patent Application Laid-open No. 52-49683, Japanese Patent Application Laid-open No. 52-93184, and others.

The prior art quoted above are able to control the generation of the yellowing and blackening to some degree. In the course of the study of this problem, the inventors have found that, when the transparent conductive film is thinned, some difference is caused in the degree of yellowing and blackening generated even with apparently the same design conditions. Specifically, in some lamps, the yellowing and blackening are more noticeable on one side than on the other side of the lamp, while in other lamps yellowing and blackening take place on both the left- and right-hand sides in a balanced manner and are generally less noticeable.

SUMMARY OF THE INVENTION

An object of the present invention is to substantially eliminate defects or drawbacks encountered in the prior art and to provide a low-pressure mercury vapor discharge lump typically represented by a rapid-start type fluorescent lamp capable of suppressing yellowing and blackening on its left-hand and right-hand sides appearing in an unbalanced manner and also provide an illuminating apparatus provided with such discharge lamp.

Another object of the present invention is to provide a low-pressure mercury vapor discharge lamp typically represented by a rapid-start type fluorescent lamp capable of providing a desired resistance distribution of a transparent conductive film formed on an inner surface of a container bulb of the lamp during the life time thereof and also capable of maintaining a high starting capability with reduced yellowing and blackening during the life time thereof and also provide an illuminating apparatus provided with such discharge lamp.

In order to achieve the above objects, the inventors of this application have conducted a variety of tests, for example, by taking into consideration that the cause of left-right unbalanced yellowing and blackening lies in the manner of forming of the transparent conductive film and the phosphor film.

The test results have confirmed that the yellowing and blackening are likely to happen (1) when the thickness of the transparent conductive film differs greatly between near the left-hand-side electrode and near the right-hand-side electrode, and thus, electrical resistance of the transparent conductive film differs greatly between on the left-hand and right-hand sides of the lamp, or (2) when the thickness of the phosphor film differs greatly between both sides of the lamp.

In the analysis of properties of the transparent conductive film, its resistance profile caught attention while its thickness profile was largely ignored. This may be attributed to the fact that since the thickness of the transparent conductive film is about 100 nm, accurate gaging of the thickness has been difficult and therefore even gaging the thickness has not been considered at all. Furthermore, the entire transparent conductive film has been relatively thick, and thus, thickness difference between both left- and right-hand sides has not been considered to essentially affect the performance of the lamp.

In view of the above, the inventors measured the thickness of the transparent conductive film using fluorescent X-ray technique. Specifically, the relationship between thickness and the fluorescent X-ray strength is determined using a material with its thickness known. Fluorescent X-ray measurements were made to the transparent conductive film, and then the results were referenced to the determined relationship to calculate the thickness of the transparent conductive film.

As a result of the measurements, it was found that, when when thickness criteria of the transparent conductive film in lamp manufacturing is set to a thin gage, the lamp performance is subjected to substantial variations and these performance variations lead to the generation of the yellowing and blackening phenomenon, and the thicker the transparent conductive film the more likely yellowing and blackening take place.

The inventors have continued their study to answer the question why the thicker the transparent conductive film the more likely yellowing and blackening take place. It has been thought that, when the transparent conductive film is thick, a film forming material remains undecomposed accordingly. While the lamp is in service, this undecomposed material is gradually decomposed, causing electrical resistance of the transparent conductive film to be decreased. As a result, the lamp tends to suffer from microscopic discharge. It has been also thought that an energy source consumed to decompose the undecomposed material is supplied by an ultraviolet rays that transmits the phosphor film.

Based on the above thinking and in view of the fact that ultraviolet ray absorption depends on the thickness of the phosphor film, the inventors have invented the arrangement which prevents the ultraviolet rays from reaching the transparent conductive film. The present invention is also applied to a fluorescent lamp that contains discharge medium other than mercury.

The aforementioned objects and other objects can be achieved in one aspect of the present invention by providing a low-pressure mercury vapor discharge lamp comprising:

- a light-transmitting tube containing discharge medium and having longitudinal end portions;
- a pair of discharge electrodes each mounted in a vicinity of the respective end portions of the tube;
- a transparent conductive film formed of metallic oxide as a main component thereof and coated on an inner surface of the light-transmitting tube between the discharge electrodes, the transparent conductive film having a thickness on one end portion of the tube relatively thinner than a thickness of the transparent conductive film on the other end portion of the tube; and
- a phosphor film coated inside of the transparent conductive film on an inside surface of the tube, the phosphor film having a thickness on the one end portion of the tube relatively thinner than a thickness of the phosphor film on the other end portion of the tube.

The discharge medium is not limited to mercury-based one. It may be rare gas, such as Xe, capable of emitting ultraviolet rays or Ne capable of emitting a large quantity of visible light together with slight quantity of ultraviolet rays.

The tubular light-transmitting tube may be constructed of soft glass, and, depending on applications, of a silica glass as well. As a pair of electrodes, either a hot cathode or a cold cathode will be utilized.

The metallic-oxide based, transparent conductive film, for example, may be a film made of tin oxide that is rendered conductive by partially reducing it or adding a tiny bit of antimony to it. Although metallic oxide is inherently an insulator, the metallic-oxide based transparent conductive film is obtained by adding additives to impart conductivity, by reducing it. Also adding additives to enhance chemical stability or physical strength is acceptable.

The inner surface means literally inner surface clear of any covering. The phosphor film may be single-layered or multi-layered. The electrically insulating film does not need to be capable of decreasing ultraviolet rays.

The film thickness means averaged film thickness on an extended region on each end of the lamp. Averaging is made to control variations involved in thickness measurements. The extended region, for example, means the region extended by 10 cm toward the direction of discharge from the electrode that is most likely to suffer the yellowing and blackening phenomenon.

In another aspect of the present invention, there is provided a low-pressure mercury vapor discharge lamp comprising;

- a light-transmitting tube containing discharge medium and having longitudinal end portions;

a pair of discharge electrodes each mounted in a vicinity of the respective end of the tube;

a transparent conductive film formed of metallic oxide as a main component thereof and coated on an inner surface of the light-transmitting tube between the discharge electrodes, the transparent conductive film having a thickness on one end portion of the tube relatively thinner than a thickness of the transparent conductive film on the other end portion of the tube;

an ultraviolet decreasing film coated on an inside surface of the transparent conductive film inside the tube; and a phosphor film coated inside of the ultraviolet decreasing film, wherein a combined thickness of the ultraviolet decreasing film and the phosphor film on the one end portion of the tube is relatively thinner than a combined thickness of the ultraviolet decreasing film and the phosphor film on the other end portion of the tube.

The ultraviolet decreasing film is the film which decreases ultraviolet rays from transmitting by absorption or reflection, and is typically a laminate or continuous film of metallic oxide powder of ZnO, $TiO_2$, CsO, α-crystalline A1203.

In a further aspect of the present invention, there is provided a low-pressure mercury vapor discharge lamp comprising:

a light-transmitting tube containing discharge medium and having longitudinal end portions;

a pair of discharge electrodes each mounted in a vicinity of the respective end portions of the tube;

a transparent conductive film formed of metallic oxide as a main component thereof with a small quantity of an additive and coated on an inner surface of the light-transmitting tube between the discharge electrodes, wherein a content of the additive in the transparent conductive film on one end portion of the tube is relatively greater than a content of the additive in the transparent conductive film on the other end portion of the tube; and a phosphor film coated inside of the transparent conductive film on an inside surface of the tube, the phosphor film having a thickness on the one end portion of the tube relatively thinner than a thickness of the phosphor film on the other end portion of the tube.

When the transparent conductive film is made of tin oxide which is partially reduced to impart conductivity, antimony may be added to stabilize conductivity. In this case, antimony added is an additive. A variety of additives are acceptable as long as transparency and conductivity are maintained.

In a still further aspect, there is provided a low-pressure mercury vapor discharge lamp comprising:

a light-transmitting tube containing discharge medium and having longitudinal end portions;

a pair of discharge electrodes each mounted in a vicinity of the respective end portions of the tube;

a transparent conductive film formed of metallic oxide as a main component thereof and coated on the inner surface of the light-transmitting tube between the discharging electrodes, wherein the transparent conductive film has a thickness on one end portion of the tube relatively thinner than a thickness of the transparent conductive film on the other end portion of the tube and has a thickness on a middle portion of the tube thicker than the thickness of the transparent conductive film on both end portions of the tube; and a phosphor film coated inside of the transparent conductive film on an inside surface of the tube, wherein the phosphor film has a thickness on the one end portion of the tube relatively thinner than a thickness on the other end portion of the container and has a thickness substantially gradually increasing from the one end portion to said other end portion of the tube.

It is important that the thickness of the phosphor film generally gradually increases from one end portion to the other end portion of the tube, and "substantially gradually increases" means that a partial decrease in thickness somewhere along the tube is acceptable.

In a still further aspect, there is provided a low-pressure mercury vapor discharge lamp comprising:

a light-transmitting tube containing discharge medium and having longitudinal end portions;

a pair of discharge electrodes each mounted in a vicinity of the respective end portions of the tube;

a transparent conductive film coated on an inner surface of the light-transmitting tube between the discharge electrodes with a stability in electrical resistance of the transparent conductive film being lower on one end portion than on the other end portion of the container; and an ultraviolet decreasing film coated on an inside surface of the transparent conductive film inside the container, the ultraviolet decreasing film having higher ultraviolet decreasing capability on one end portion than on the other end portion of the tube.

The stability of electrical resistance of the transparent conductive film refers to the one against ultraviolet rays. For example, a decreased stability of electrical resistance is noticed on the thicker portion of conductive film where a decomposed material is contained more in amount while an increased stability results on the thinner portion of conductive film. In the tin-oxide based conductive film, the higher the concentration of antimony as an additive, the higher electrical resistance of the film.

The ultraviolet decreasing film comprises phosphor film. The ultraviolet decreasing film may be a laminate made of a single phosphor film and an ultraviolet ray absorbing film.

In the above respective aspects, the transparent conductive film has a central portion partially having a thickness thicker than a thickness of each of both the end portions. The transparent conductive film has a central portion partially having an electric resistance smaller than that of each of both the end portions thereof. The transparent conductive film has a maximum thickness equal to or less than 100 nm.

The ultraviolet decreasing film comprises phosphor film. The ultraviolet decreasing film may be a laminate made of a single phosphor film and an ultraviolet ray absorbing film.

When the middle portion is more thickly structured as stated above, the middle portion does not necessarily mean the exact center of the tube between both ends. Slight deviation of the middle portion toward either end is acceptable.

The discharge lamp lighting device is a rapid-start type discharge starter.

According to the characteristics of the embodiments described above of the present invention, the quantity of ultraviolet rays that reaches the transparent conductive film through the thick portion of the phosphor film is reduced. The transparent conductive film corresponding to the thick portion of the phosphor film is also thick and contains more undecomposed material. However, the reduced quantity of ultraviolet rays slows the decomposition process of the undecomposed material and thus controls the change in electrical resistance there. On the other hand, the quantity of ultraviolet rays that reaches the transparent film through the thin portion of the phosphor film is relatively large. However, the transparent conductive film there is also thin, with a small amount of undecomposed material contained, and thus, the change in electrical resistance remains small. As a result, the change in electric resistance in the transparent conductive film is balanced on both end portions of the container, and the lamp is free from substantial yellowing and blackening phenomenon on one particular end arising from a resistance change on that end.

In another aspect of the present invention, the transparent conductive film is subjected to more change in electrical resistance on its thick portion and less change on its thin portion. Both the ultraviolet decreasing film and the phosphor film restrict ultraviolet rays transmission therethrough that causes resistance change, and the thicker the overall thickness of both films the more ultraviolet rays is restricted. The thick portion of the transparent conductive film that is subjected to more resistance change is coated with the thick portions of the ultraviolet decreasing film and the phosphor film combined, which provide high ultraviolet decreasing capability. The thin portion of the transparent conductive film that is subjected to less resistance change is coated with the thin portions of the ultraviolet decreasing film and the phosphor film combined, which provide low ultraviolet decreasing capability. The change in electrical resistance of the transparent conductive film is balanced on both end portions of the container. The lamp is free from substantial yellowing and blackening on one particular end arising from a resistance change on that end.

In a further aspect of the present invention, the electric resistance in the transparent conductive film is more stable where more additive is contained therein. The thick portion of phosphor film is formed so that the portion with less additive, thus provided with less stability in electrical resistance, is exposed to less ultraviolet rays. The change in electrical resistance in the transparent conductive film is balanced on both end portions of the tube. The lamp is free from substantial yellowing and blackening on one particular end arising from a resistance change on that end.

In a still further aspect of the present invention, the quantity of ultraviolet rays that reaches the transparent conductive film through the thick portion of the phosphor film is reduced in the same manner described above. The transparent conductive film corresponding to the thick portion of the phosphor film is also thick, and contains more undecomposed material. However, the reduced quantity of ultraviolet rays reached slows the decomposition process of the undecomposed material and thus controls the change in electrical resistance there. On the other hand, the quantity of ultraviolet rays that reaches the transparent film through the thin portion of the phosphor film is relatively large. However, the transparent conductive film there is also thin, with a small amount of undecomposed material contained, and thus, the change in electrical resistance remains small. As a result, the change of electrical resistance in the transparent conductive film is balanced on both end portions of the tube, and the lamp is free from substantial yellowing and blackening on one particular end arising from a resistance change on that end.

The phosphor film is typically formed by allowing phosphor suspension to run in straight glass tube with the straight glass tube secured in an upright position. Thus, the glass tube has phosphor film thinnest on its top side (inside) and gradually thick as it runs downward. In view of this, a high resistance side, that is, a thin end portion of the transparent conductive film is formed corresponding to the thin portion of the phosphor film on the top side of the tube, and a low resistance side, that is, a thick end portion of the transparent conductive film is formed corresponding to the thick portion of the phosphor film on the bottom side of the tube. The change in electrical resistance in the transparent conductive film is balanced on both end portions of the tube, and the lamp is free from substantial yellowing and blackening on one particular end arising from a resistance change on that end.

In a still further aspect of the present invention, the ultraviolet decreasing film is arranged so that its higher ultraviolet decreasing capability portion is formed on less resistance stabilized portion of the transparent conductive film. The change in electrical resistance in the transparent conductive film is balanced on both end portions of the tube, and the lamp is free from substantial yellowing and blackening on one particular end arising from a resistance change on that end.

The both end portions of the transparent decreasing film is relatively thin, thus of a high resistance, and with less quantity of undecomposed material that is the cause for resistance change in the life of the lamp. The change in electrical resistance is restricted, and the yellowing and blackening generations are thus effectively controlled.

The electrical resistance on both end portions of the transparent conductive film is relatively large, and microscopic discharge is restricted, effectively controlling the generation of the yellowing and blackening.

The thickness of the transparent conductive film is entirely thin, and balanced change of electrical resistance on both end portions is achieved, effectively controlling the generation of the yellowing and blackening.

In a still further aspect of the present invention, there is provided a low-pressure mercury vapor discharge lamp comprising:

a light-transmitting tube containing discharge medium and having longitudinal end portions;

a pair of discharge electrodes each mounted in a vicinity of the respective end portions of the tube;

a transparent conductive film formed of metallic oxide as a main component thereof and coated on an inner surface of the light-transmitting tube between the discharge electrodes, the transparent conductive film including an additive wherein a containing ratio of the additive at both the end portions of the tube is made higher than that at a central portion thereof and an electric resistance at both the end portions of the tube is made higher than that at the central portion thereof.

In this aspect, the light-transmitting tube is usually a glass bulb. The transparent conductive film contains mainly a metallic oxide but includes an additive, undecomposed compound, partially reduced metal or impurity, and a mixture may be used as a metallic oxide. The amount of the additive to be included is a small amount capable of applying electric conductivity and utilizing for adjusting a resistance. Both the end portions of the tube means portions in the vicinity of the electrodes apart from about 20 cm towards inside the tube and the central portion thereof means a portion near the central portion of the discharge lamp. The amount of the additive near the central portion may includes approximately zero.

In a still further aspect, there is provided a low-pressure mercury vapor discharge lamp comprising:

a light-transmitting tube containing discharge medium and having longitudinal end portions;

a pair of discharge electrodes each mounted in a vicinity of the respective end portions of the tube;

a transparent conductive film formed of metallic oxide as a main component thereof and coated on an inner surface of the light-transmitting tube between the discharge electrodes, the transparent conductive film including an additive wherein a containing ratio of the additive at both the end portions of the tube is made higher than that at a central portion thereof and an electric resistance at both the end portions of the tube is made higher than that at the central portion thereof; and a phosphor film coated inside of the transparent conductive film on an inside surface of the tube.

In these aspect, the metallic oxide is a tin oxide and the additive is an antimony, and the antimony containing ratio at both the end portions of the tube is within 0.8 to 2.0 mol % and the antimony containing ratio at the central portion of the container is within 0.2 to 1.0 mol %. In these aspect, the transparent conductive film has a thickness at both the end portions of the tube thinner than that at the central portion thereof. The thickness of the transparent conductive film at each of both the end portions of the tube is equal to or less than 25 nm.

According to the embodiments of these aspects, the concentration of the additive in the transparent conductive film is made low at the central portion thereof and made high at both the end portions thereof. Although the metallic oxide essentially has an electrically insulative property, the conductivity is created by partially reducing the metallic oxide or adding the additive, and in the case of adding the additive, the conductivity, i.e. resistance, less varies and stabilizes. Thus, the resistance at the end portions at which the concentration of the additive is stabilized, and the resistance at the central portion is not stabilized because of low additive concentration and gradually lowers. That is, the resistance at the central portion of the conductive film is positively controlled so as not to be stabilized and the concentration of the additive is made lower. Accordingly, the oxygen is released in the light-transmitting tube to thereby lower the resistance of the transparent conductive film, thus the resistance distribution approaching an ideal V-shape.

Furthermore, according to these aspects of the present invention, tin oxide as the main component of the transparent conductive film and antimony as the additive are combined and such combination is widely utilized, thus being reliable. In such combined use, a desired resistance distribution is easily obtained with the antimony content of 0.8 to 2.0 mol % at the end portions of the light-transmitting tube and of 0.2 to 1.0 mol % at the central portion thereof. In the case of less than 0.8 mol % of the antimony concentration, at the end portions of the tube, the resistance is less stabilized, and on the contrary, in the case of more than 2.0 mol %, the transmittance of the transparent conductive film is likely lowered because of the increasing of the impurity. In the case of less then 0.2 mol % of the antimony concentration at the central portion of the tube, the stabilizing degree of the resistance of the conductive film is excessively lowered, whereby the resistance is hence liably lowered and a small discharge is caused at the central portion of the tube, resulting in the generation of the blackening phenomenon at this portion. In the case of more than 1.0 mol % at the central portion, the resistance is remarkably stabilized and it becomes difficult to obtain an ideal V-shaped resistance distribution.

Furthermore, according to the aspect in which the film thickness at the end portion of the tube is thinner than that at the central portion of the tube, the film thickness is in reverse proportion to the resistance, so that the ideal V-shaped resistance distribution can be obtained by controlling the film thickness, and more ideal V-shaped resistance distribution will be obtained by promoting the lowering of the resistance at the central portion of the tube due to the concentration control of the additive.

The film thickness of the transparent conductive film is made to less than 25 nm at the end portions of the tube, which is thinner than a film thickness of a conventional conductive film of40 to 60 nm, so that an undecomposed compound less remains and the resistance change during the using of the lamp is hence made small. It is not necessary to make limit the lower limit of the film thickness, but, in the case of less than 10 nm, a desired conductivity will be hardly achieved.

In a still further aspect of the present invention, there is provided a low-pressure mercury vapor discharge lamp comprising:

a light-transmitting tube containing discharge medium and having longitudinal end portions;

a pair of discharge electrodes each mounted in a vicinity of the respective end portions of the tube; and a transparent conductive film formed of metallic oxide mainly containing tin oxide including antimony of 0.7 to 2.0 mol % and coated on an inner surface of the container between the electrodes, wherein the transparent conductive film has a central portion having a thickness equal to or less than 100 nm and both end portions each having a thickness equal to or less than 25 nm and wherein the central portion of the transparent conductive film has the thickness larger than that of each of the end portions and the transparent conductive film has a resistance of 2 kΩ to 50 kΩ per 10 cm of a longitudinal length of the tube at the central portion thereof and a resistance of 20 kΩ to 1000 kΩ per 10 cm of the longitudinal length of the tube at each of the end portions thereof.

In this aspect, the light-transmitting tube is usually a glass bulb. The transparent conductive film contains mainly a metallic oxide but includes an additive, undecomposed compound, partially reduced metal or impurity, and a mixture with another metallic compound including a relatively much tin oxide may be used. The amount of the additive to be included is a small amount capable of applying electric conductivity and utilizing for adjusting a resistance. Both the end portions of the tube means portions in the vicinity of the electrodes apart from about 20 cm towards inside the tube, and the central portion thereof means a portion except the end portions. The amount of the additive means a mean value at the respective portions.

In a still further aspect, there is provided a low-pressure mercury vapor discharge lamp comprising:

a light-transmitting tube containing discharge medium and having longitudinal end portions;

a pair of discharge electrodes each mounted in a vicinity of the respective end portions of the tube; and a transparent conductive film formed of metallic oxide mainly containing tin oxide including antimony of 0.7 to 2.0 mol % and coated on an inner surface of the tube between the electrodes, wherein the transparent conductive film has a central portion having a thickness equal to or less than 100 nm and both end portions each having a thickness equal to or less than 25 nm and wherein the central portion of the transparent conductive film has the thickness larger than that of each of the end portions and the transparent conductive film has a resistance of 2 kΩ to 50 kΩ per 10 cm of a longitudinal length of the tube at the central portion thereof and a resistance of 20 kΩ to 1000 kΩ per 10 cm of the longitudinal length of the tube at each of the end portions thereof; and a phosphor film formed on an inside surface of the transparent conductive film.

In these aspects, the central portion of the transparent conductive film of the container has a resistance higher than that of each of the end portions thereof.

According to these aspects of the present invention, the transparent conductive film has the central portion having a thickness thinner than that of the end portions thereof and the central portion has a resistance in a predetermined range, so that a fine V-shaped resistance distribution with less blackening can be obtained. Furthermore, since the antimony concentration is within 0.7 to 2.0 mol %, the resistance change of the transparent conductive film during the use of the lamp is made small in comparison with the case of less than 0.7 mol % of the antimony concentration. Further, the lowering of the light transmittance due to the addition of the antimony can be effectively suppressed because the antimony concentration does not exceed 2.0 mol %. In this range of the antimony concentration, the resistance of the transparent conductive film approaches substantially minimum value or near, thus being capable of forming the transparent conductive film with thin thickness.

Still furthermore, the transparent conductive film of these embodiments is formed thinner than a conventional transparent conductive film. That is, the end portion thereof has a thickness of less than 25 nm, which is thinner than that of the conventional one of40 to 60 nm. Concerning the central portion of the transparent conductive film, it has a thickness of less than 100 nm in comparison with a conventional one having a thickness of more than 100 nm at the central portion. Since the transparent conductive film of the present embodiment has uniform resistance and thickness, it has small gap ratio and fine structure, so that the undecomposed compound less remains in the film, thus effectively suppressing the resistance change during the use of the lamp. Such advantageous effect is not expected by the conventional formation of the transparent conductive film having a large gap ratio. Furthermore, the transparent conductive film of the present embodiment is less reacted and decomposed after the completion of the product lamp, so that the generation of impurity due to the decomposing reaction can be suppressed in minimum, thus obtaining a good startability of the lamp.

In a still further aspect of the present invention, there is provided an illuminating apparatus comprising:

a main illuminating unit;

a low-pressure mercury vapor discharge lamp, of the characters described above in the respective aspects, attached to the main illuminating unit; and a discharge lamp lighting device mounted on the main illuminating unit for driving the low-pressure mercury vapor type discharge lamp.

The discharge lamp lighting device is a rapid-start type discharge starter.

The illuminating apparatus provided with the low-pressure mercury vapor discharge lamp having characteristic features described above can attain substantially the same effects and advantages as those described hereinabove.

DESCRIPTION OF THE PREFERRED EMBODIMENTS

Figure 1A:
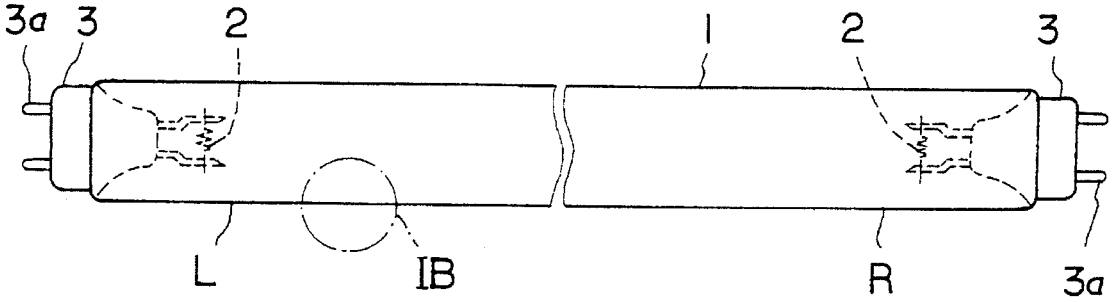
FIG. 1A is a front view showing an embodiment of a low-pressure mercury vapor discharge lamp according to the present invention.
Figure 1B:
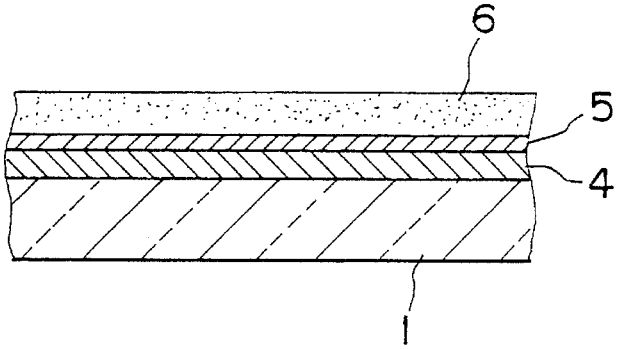
FIG. 1B is an partially enlarged view of the lamp, encircled by 1B, of FIG. 1A.
Figure 2:
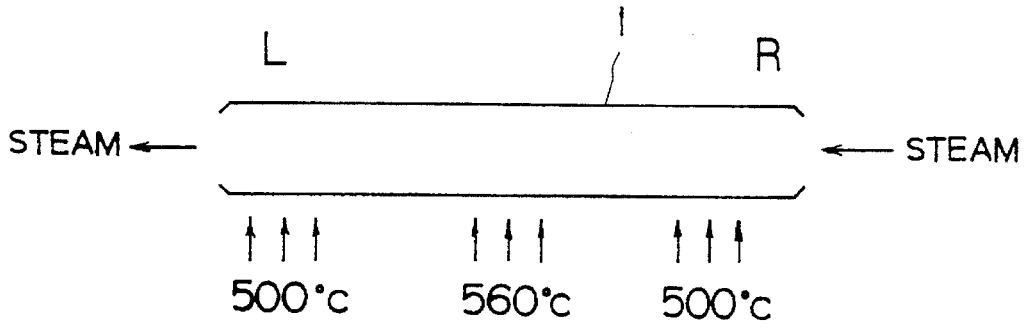
FIG. 2 is an illustrated view showing a manufacturing process of a transparent conductive film of the discharge lamp of FIG. 1.
Figure 3:
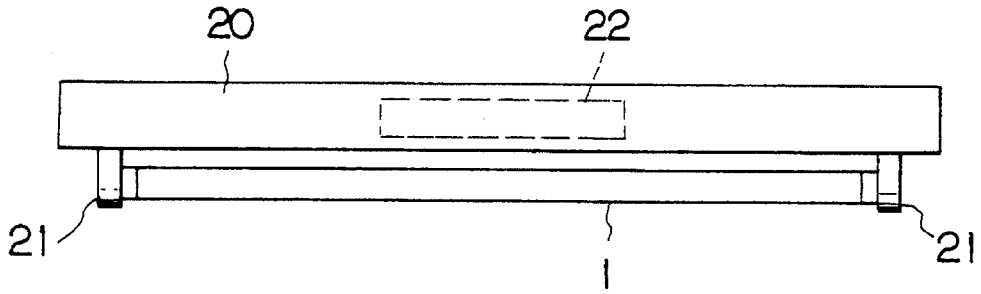
FIG. 3 is a front view showing an illuminating apparatus provided with the discharge lamp of FIG. 1.
Figure 4:
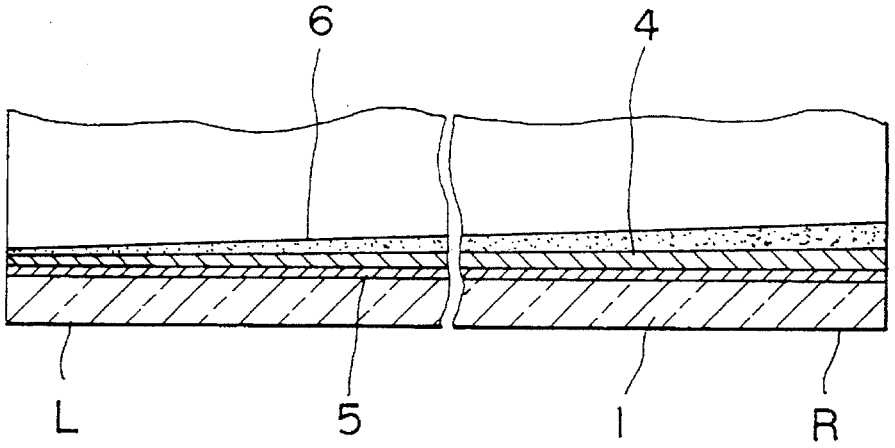
FIG. 4 is a cross-sectional view showing the discharge lamp of FIG. 1.
Figure 5A:
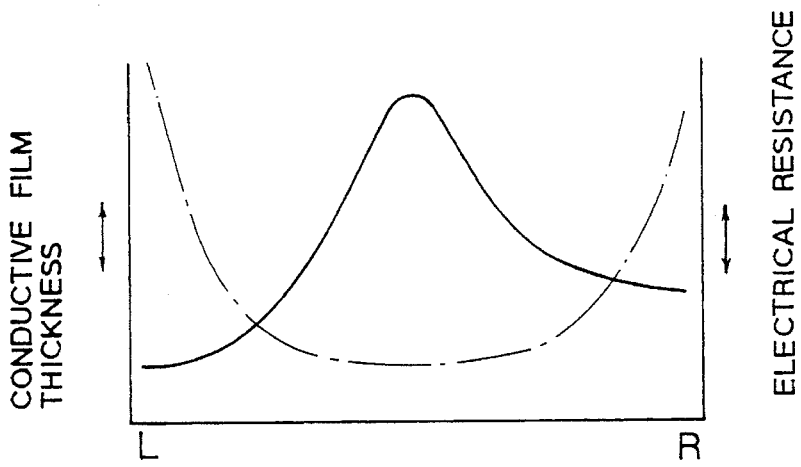
FIG. 5A is a graph showing a relationship between a thickness and an electrical resistance of the transparent conductive film of the discharge lamp of the embodiment.
Figure 5B:
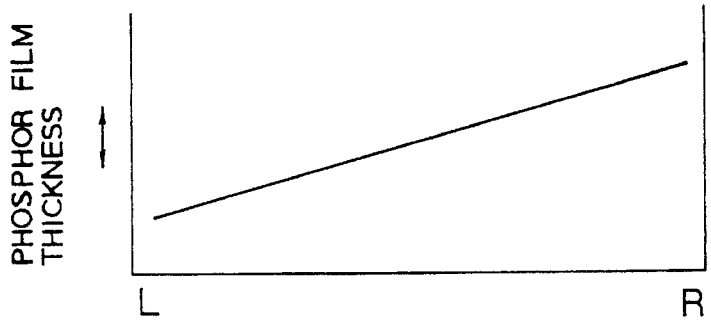
FIG. 5B is a graph showing the thickness profile of a phosphor film of the embodied discharge lamp.
Figure 5C:
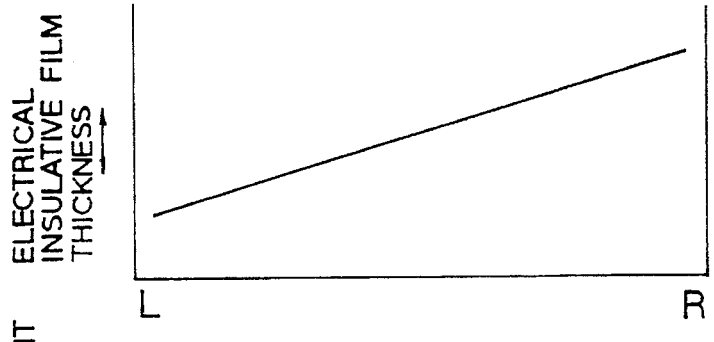
FIG. 5C is a graph showing the thickness profile of an insulator film (protection film) of the embodied discharge lamp.
Figure 5D:
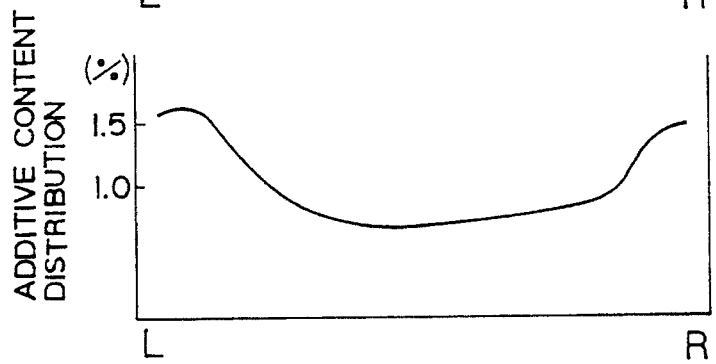
FIG. 5D is a graph showing the distribution of an additive content in the transparent conductive film of the embodied discharge lamp.
Figure 5E:
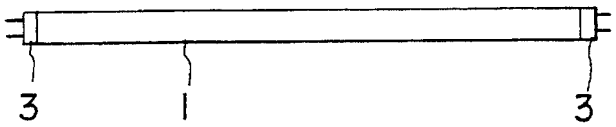
FIG. 5E is an illustration of the discharge lamp of this embodiment having the longitudinal length corresponding to the axes of abscissa of FIGS. 5A to 5D.

Referring to the drawings, preferred embodiments of the present invention are discussed, in which FIGS. 1 to 3 are commonly utilized for the respective embodiments.

FIG. 1 is a front view showing a first embodiment of the fluorescent lamp as one typical example of a low-pressure mercury vapor discharge lamp of the present invention, and FIG. 1B is a cross-sectional view showing an enlarged view of the portion 1B in FIG. 1A. The basic construction in FIG. 1A meets with with FLR40S.W/M specified in Japanese Industrial Standards (JIS). The fluorescent lamp has a pair of discharging electrodes 2 including filaments, sealed in a tubular light-transmitting sealed container, that is, a glass bulb or tube 1 with each electrode supported on a longitudinal end of the bulb 1. Support leads which support filaments pass through the glass bulb 1 in an air-tight manner and are connected to lamp pins 3*a* which are projected out of caps 3 at both end of the glass bulb 1. Contained inside the glass bulb 1 are a small quantity of mercury and argon of 266 to 400 Pa (2 to 3 Torr).

The inner surface of the glass bulb is coated with a transparent conductive film 4. The transparent conductive film 4 contains tin oxide as its main component and a part of tin oxide is reduced to impart conductivity to the transparent conductive film. The transparent conductive film also contains a tiny bit of antimony to stabilize the conductivity. Antimony having a valence of 3 that is replaced with tin having a valence of 4 in the transparent conductive film 4 imparts conductivity as reduced tin oxide does.

The antimony content in the transparent conductive film 4 is 1.5 mol % on both end portions and 0.7 mol % on its middle portion.

The transparent conductive film 4 is 10 nm thick on the right-hand end portion R and left-hand end portion L, and 60 nm thick on its middle portion. Preferably, thickness on both end portions is 25 nm or less, and that on the middle portion is 100 nm or less. Thickness is determined on the calibration curve of Sn strength of fluorescent X-ray as already mentioned. An electrical resistance of the transparent conductive film 4 per unit length (10 cm) along the direction of length is 200 Ω on the right-hand end portion R, 300 Ω on the left-hand end portion L, and 1 KΩon the middle portion.

Coated on top (inside surface) of the transparent conductive film 4 is an electrically insulating film 5 which is a laminate made of aluminum oxide powder. The insulator film 5 has no ultraviolet absorbing capability. The diameter of aluminum oxide powder particles ranges from 0.05 to 0.1 μm. The average thickness of the insulator film 5 on both end portions is 1 to 3 μm, while the thickness on the right-hand end portion R is relatively thicker than that on the left-hand end portion L. The insulator film 5 keeps mercury out of contact with the transparent conductive film 4 so that mercury may not react with tin or antimony in the transparent conductive film 4. The insulator film 5 thus prevents the transparent conductive film 4 from changing in quality. The insulator film 5 performs a function of restricting microscopic discharge because of its electrically insulating nature.

Coated on top (inner surface) of the insulator film 5 is a phosphor film 6 that faces a discharge path. The phosphor film 6 contains antimony, manganese, and keep-alive halocalcium phosphor as its main components. The phosphor film 6 is about 35μm thick on the right-hand side portion R, and about 25 μm on the left-hand side portion L. Rare earth phosphors used in the recently widely used three band fluorescent lamp specified in Japanese Industrial Standards (JIS) are also acceptable as phosphor film material. Thicknesses of the insulator film 5 and the phosphor film 6 are determined by using a known fluorescent X-ray method.

The transparent conductive film 4 is manufactured in the following procedure. FIG. 2 is a diagram showing the manufacturing process of the transparent conductive film. A tubular glass bulb 1 opened at both ends is prepared. The glass bulb 1 held at its horizontal position is put into a heating oven, and then heated. The glass bulb is heated on its middle portion at about 560° C., and on its end portions at about 500° C. In this state, mixed vapors of tin tetrachloride and antimony trichloride are introduced into the glass bulb 1 through one opening, and then pushed out of the glass bulb 1 through the other opening. This process allows dimethyltin dichloride and antimony trichloride to be put into contact with heated glass bulb 1, and then decomposed, oxidized, and then deposited in the form of tin oxide and antimony oxide onto the inner surface of the glass bulb 1. The molar ratio of dimethyltin chloride to antimony trichloride is approximately 99.3:0.7. This ratio determines the antimony content in the transparent conductive film 4 on the middle portion of the glass bulb 1 in its finished state.

On both end portions of the glass bulb 1, heating temperature is relatively low enough to slow the rate of reaction, and thus part of the supplied vapors allowed to pass without reacting, out of the other opening of the bulb 1. Since a high pressure vapor is easily pushed out compared with a low pressure vapor, the low pressure vapor material reacts and deposits more on the low heating temperature portions. The vapor pressure of dimethyltin chloride (the vapor pressure of tin chloride immediately before decomposition and deposit) is higher than that of antimony trichloride, and thus, the antimony content of the deposit on both ends is higher than the antimony content of the mixed vapor. In contrast, on the middle portion of the bulb 1, the supplied vapors react and deposit as it is, and the antimony content of the deposit there is equal to the antimony content in the supplied vapor. As a result, the antimony content on the middle portion of the bulb 1 is thus lower than that on both end portions of the bulb 1. The difference in heating temperature cause not only the difference in the antimony content but also a thickness difference, and thus, a thick portion on the middle of the bulb 1 and a thin portion on both ends because of the difference of resulting quantity of deposit. The thickness profile is formed so that electrical resistance on the middle portion is low.

Even if the supply side of the bulb for the vapor (on the right-hand side R) and the discharge side of the bulb (on the left-hand side L) are heated for reaction under the same temperature, both sides are different in the quantity of deposit with a thick deposit formed on the supply side and a thin deposit on the discharge side. This is because the discharge side is naturally short of materials for deposits.

If no difference is desired in the antimony content from location to location, the vapor of dimethyl dichloride and antimony trichloride is allowed into the bulb 1 to undergo decomposition process for film forming while the middle portion and both end portions of the bulb 1 are heated at a temperature of 500° C. for a predetermined time. After that, the middle portion of the bulb 1 is heated at a temperature of 500° C. to complete the transparent conductive film 4.

When it is required to provide a difference in the antimony content between on the left-hand end portion L and on the right-hand end portion, different heating temperatures will be applied to both end portions. In this case, however, the antimony content on the left-hand end portion where the thin portion of the phosphor film 6 is applied is preferably set higher than that on the right-hand end portion. This helps to stabilize electrical resistance on the left-hand end portion L which is exposed more to ultraviolet rays which causes resistance change in the transparent conductive film 4.

Different types of compounds containing tin and antimony result in different vapor pressures within heating temperature range, and thus, the antimony content on both end portions is set lower than that on the middle portion in the transparent conductive film 4.

The insulator film 5 is coated on top of the transparent conductive film 4 by coating, on the transparent conductive film 4 inside the bulb 1, a coating solution containing aluminum oxide power and then by drying the same. Next, the bulb 1 is coated with the phosphor coating solution. After allowing the phosphor coating to dry, it is then sintered. The discharging electrodes 2 are mounted on both ends of the glass bulb 1. The glass bulb 1 is then evacuated through an exhaust pipe while the interior of the bulb 1 is heated. A small quantity of mercury and argon are introduced into the bulb 1 and the bulb 1 is then completely sealed. The caps 3 are mounted on both ends of the bulb 1. Lead wires are connected to pins 3*a*. This concludes the manufacturing process of the fluorescent lamp.

Each of the phosphor coating solution and the aluminum-oxide powder containing solution is applied by running from top down inside the bulb 1 that has already the transparent conductive film 4 coated. In this operation, the bulb 1 is held in an upright position wherein positioned on top is the left-hand end portion L which has the thin portion of the transparent conductive film 4 compared to the right-hand end portion. Then, each coating is allowed to dry. When each of the coating solutions is run from top down inside the bulb 1 in its upright position, the top side of the bulb 1, namely, the left-hand end portion L is thinly formed compared to the right-hand end portion R.

The fluorescent lamp thus processed is mounted on an illuminating apparatus main unit 20 which is equipped with circuit components 22 such as ballast for starter circuit of the rapid-start fluorescent lamp. The illuminating apparatus main unit 20 is also provided with sockets 21 that mechanically hold and electrically connects the fluorescent lamp.

FIG. 5 shows diagrammatically thickness profiles of the transparent conductive film 4, the insulator film 5, and the phosphor film 6, and the content profile of an additive such as antimony. As seen from FIG. 5A, the electrical resistance of the transparent conductive film 4 is inversely proportional to the thickness of the transparent conductive film 4.

When the fluorescent lamp thus processed is driven by an ordinary starter device, thermoelectrons emitted by a discharging electrode filament functioning as a cathode travel via the transparent conductive film 4 and reach another discharging electrode filament functioning as an anode, thus forming a discharge path. The lamp immediately lights, and a light in a given band is emitted through the phosphor film 6.

While the lamp lights, microscopic discharges take place between mercury particles in the bulb 1 and the transparent conductive film 4. This causes the phosphor film 6 between the transparent conductive film 4 and a plasma discharge path to break down and the tin oxide to react with mercury, leading to yellowing and blackening near discharge electrode filaments. According to the present invention, however, the generations of the yellowing and blackening are balanced between on the left-hand end portion and on the right-hand end portion, and become substantially less visible compared with conventional fluorescent lamps. Furthermore, the fluorescent lamp offers a slowed reduction in light flux within service life.

The mechanism for preventing the yellowing and blackening is thus summarized as follows. Since the thick portion of the phosphor film 6 is coated on the inside surface of the transparent conductive film 4 on the right-hand end portion R where more undecomposed material remains after the film forming, the thick portion of the phosphor film 6 absorbs relatively more ultraviolet rays, thus transmitting less ultraviolet rays, compared with the opposite situation (where the thin portion of the phosphor film is coated on the inside surface of the thick portion of the transparent conductive film) while the lamp is operated. This arrangement restricts the reaction of the ultraviolet rays with undecomposed material that is more on the right-hand end portion of the transparent conductive film 4. The thick portion also makes the yellowing and blackening less visible.

In the thin portions of the transparent conductive film 4 and the phosphor film 5, the rate of reaction during use is small because there is less undecomposed material in the transparent conductive film 4 even if the thin portion of the phosphor film 6 allows more ultraviolet light to transmit therethrough. This arrangement keeps the change in electrical resistance to a minimum value, and even if the yellowing and blackening are as marginal as those on the other side and substantially less visible as a whole. In the above embodied fluorescent lamp according to the present invention, the inner surface of the bulb 1 is coated with the transparent conductive film 4, the electrically insulating film 5, and the phosphor film 6. Alternatively, the insulator film 5 is dispensed with. The fluorescent lamp without the insulator film 5 has performed equally as good as the fluorescent lamp with the insulator film 5.

The inventors have produced and tested a variety of lamps with films according to the present invention and other types of films in order to study further lamp characteristics in terms of the yellowing and blackening and the rate of reduction in light flux.

A first test lamp is an FLR40W lamp having an inner surface coated with the transparent conductive film 4, aluminum oxide powder containing film as the insulator film 5, and halo-calcium phosphate phosphor as the phosphor film 6 in that order. A second test lamp is identical to the first test lamp except that a three-band phosphor replaces halo-calcium phosphate phosphor as the phosphor film 6. A third test lamp is also identical to the first lamp except that the insulator film 5 is dispensed with. A fourth test lamp is identical the second test lamp except that the insulator film 5 is dispensed with. The second through fourth test lamps are all identical to the first test lamp otherwise noted above.

A first comparative lamp through a fourth comparative lamp are identical to the first through fourth test lamps, respectively, except that in all comparative lamps the thick portion of the transparent conductive film 4 is reversed. In the comparative lamps, the thick portion and the thin portion of the phosphor film 6 correspond to the thin portion and the thick portion of the transparent conductive film 4, respectively.

These lamps were subjected to the continuous running test in which the specimens were checked for the yellowing and blackening, and the reduction in light flux have been checked at the moment of 3000-hour and 5000-hour points. The reduction rate in light flux is referenced to 0-hour starting point. The following Table shows the test results. In the table, ○ denotes excellent, Δ denotes acceptable and X denotes poor.

TABLE

| Test lamp | Film structure | Yellowing | Blackening | Light flux rate 3000 H | Light flux rate 5000 H |
|---|---|---|---|---|---|
| 1st lamp | Trans. cond. film: Alumina Insul. film: | o | o | 95% | 93% |
| 1st com. lamp | Halo-phosphate Phosphor film | x | Δ | 92% | 91% |
| 2nd lamp | Trans. cond. film: Alumina Insul. film: | o | o | 95% | 94% |
| 2nd com. lamp | 3 band phosphor Phosphor film | x | Δ | 92% | 91% |
| 3rd lamp | Trans. cond. film: Alumina | o | o | 94% | 92% |
| 3rd com. lamp | Halo-phosphate Phosphor film | x | x | 90% | 89% |
| 4th lamp | Trans. cond. film: Alumina | o | o | 93% | 92% |
| 4th com. lamp | 3 band phosphor Phosphor film | x | Δ | 91% | 90% |

As seen from Table, the lamps (test lamps) according to present invention suffer less yellowing and blackening and give satisfactory reduction rate of light flux.

The present invention is not limited to the above embodiment. For example, the insulator film 5 may be of a type that has an ultraviolet decreasing capability such as those constructed of ZnO, $TiO^2$, CsO. The ultraviolet decreasing insulator 5 screens more effectively the ultraviolet rays that would change the electrical resistance, thus stabilizing electrical resistance of the transparent conductive film 4. In this case, the thickness profile of the insulator 5 is designed to agree with those of the phosphor film 6 and the transparent conductive film 5.

It is contemplated that the thickness profile of the insulator 5 having the ultraviolet decreasing capability is designed opposite to that of the phosphor film 6. In this case, both the insulator film 5 and the phosphor film 6 are considered as a combined film, and then either end portion that has a higher ultraviolet decreasing capability (namely, the larger combined thickness side) is coated on the thick portion of the transparent conductive film 4. Then, equally effective results may be obtained.

Furthermore, alternatively, xenon (Xe) may substitute for mercury as a discharge gas. Xenon emits a high level of ultraviolet rays which varies greatly the electrical resistance of the transparent conductive film 4. This leads to microscopic discharges in the vicinity of discharge electrodes, a diversity of reactions with phosphor and glass would be triggered By microscopic discharges, though no reaction with mercury takes place. Deterioration in appearance and light flux would take place. The use of the present invention, however, controls the above problems.

Spray method may be used to form a transparent conductive film. To take advantage of the present invention, the resistance profile of the transparent conductive film 4 is not limited to a V-shaped curve.

Figure 6:
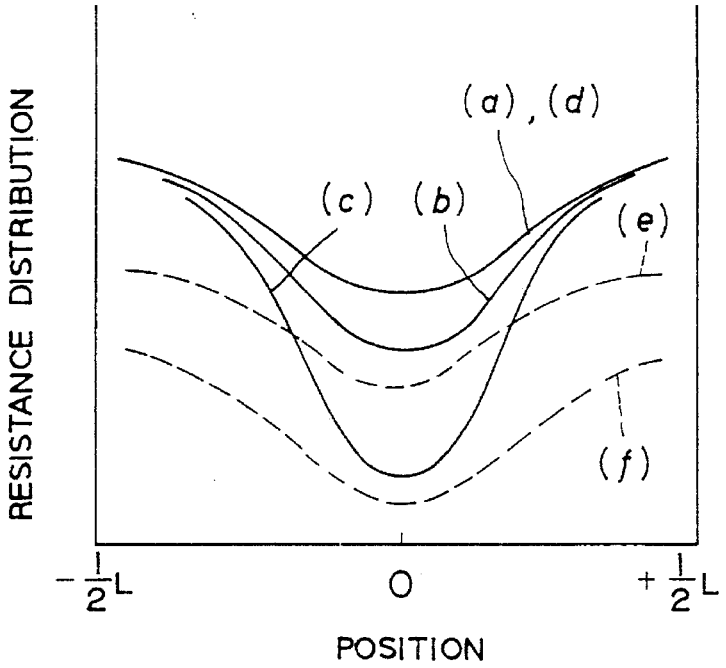
FIG. 6 is a graph showing a relationship between a resistance distribution of a transparent conductive film of a low-pressure mercury vapor discharge lamp of another embodiment of the present invention and a position of the transparent conductive film in its longitudinal direction.

Furthermore, concerning the low pressure mercury vapor type discharge lamp, i.e. fluorescent lamp, of another embodiment, in which FIGS. 1 to 3 are commonly applied, the resistance distribution of the transparent conductive film 4 of the fluorescent lamp was measured at times of (a) just after the formation of the conductive film 4, (b) just after the completion of a fluorescent lamp as a product, and (c) after the 1000 hour lighting time, and the resistance distribution of a transparent conductive film of a conventional fluorescent lamp was also measured at times of (e) just after the formation of the conductive film 4, (f) just after the completion of a fluorescent lamp as a product, and (g) after the 1000 hour lighting time. Antimony was not added to the transparent conductive film 4, which has a film thickness of about 50 nm at its ends and of about 100 nm at its central portion of the bulb. The measured results are shown in FIG. 6, in which the abscissa axis represents a position in a fluorescent lamp and the ordinate axis represents a resistance per unit length, i.e. rate of resistance. The position on the axis of abscissa is represented by +½L on the right-hand side and −½L on the left-hand side.

According to the measurement results, the resistance of the transparent conductive film of the present embodiment less varies at the end of the bulb 1 at which it shows high antimony content and largely varies at the central portion thereof at which it shows low antimony content. Such variation of the resistance is caused during the production of the fluorescent lamp, for example, by the oxidation of tin in the fluorescent body sintering process and the reduction (deoxidation) of the tin oxide in the gas-discharging process. Furthermore, during the lighting of the fluorescent lamp, oxygen is removed from the tin oxide and tin remains, thus increasing the conductivity.

The antimony has a property for stabilizing the conductivity, in the fluorescent lamp according to this embodiment, the resistance of the transparent conductive film less varies at the end portions of the bulb and largely varies at the central portion thereof. Because of this reason, the resistance distribution of the conductive film reaches an ideal V-shape.

On the contrary, the resistance value of the transparent conductive film of the fluorescent lamp of the conventional structure varies at every portion of the bulb, and for this reason, the resistance distribution never provide an ideal V-shape.

In comparison of a fluorescent lamp A having the resistance distribution of the above (a) to (c) with a fluorescent lamp B of the resistance distribution of the above (d) to (f) at a time when they were lightened, the blackening phenomenon was visually observed after the lighting time of about 1500 hours with respect to the lamp A but such blackening phenomenon was visually observed after the lighting time of about 1000 hours with respect to the lamp B.

As described hereinbefore with reference to FIG. 2, the transparent conductive film having the above resistance distribution will be similarly manufactured in the following manner with reference to FIGS. 7A and 7B.

Figure 7A:
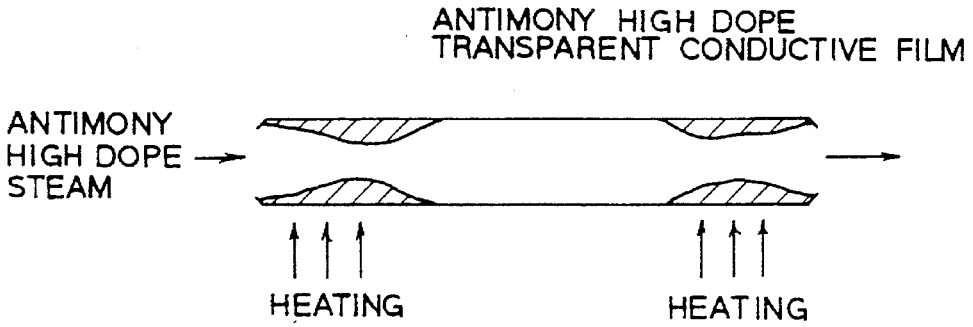
FIGS. 7A and 7B are illustrated views showing another manufacturing process of a transparent conductive film of the discharge lamp of FIG. 1 according to another embodiment of the present invention.

As shown in FIG. 7A, a tubular glass bulb 1 opened at both ends is prepared. The glass bulb 1 held at its horizontal position is put into a heating oven and then only the end portions thereof are heated at a temperature of about 580° C. Under this state, mixed vapors of tin tetrachloride and antimony trichloride are introduced into the glass bulb 1 from one end opening thereof and then discharged therefrom through the other end opening. During this process, the dimethyltin dichloride and antimony trichloride are put into contact with the heated glass bulb 1 and then decomposed, oxidized and deposited in the form of tin oxide and antimony oxide onto the inner surface of the bulb 1. The molar ratio of the dimethyltin chloride to the antimony trichloride is approximately 99.3:0.7. The antimony content in the transparent conductive film 4 at the end portion of the bulb 1 accords with this ratio because of high heating temperature. At this time, the conductive film 4 is less formed at the central portion of the glass bulb 1 because that portion is not heated.

Figure 7B:
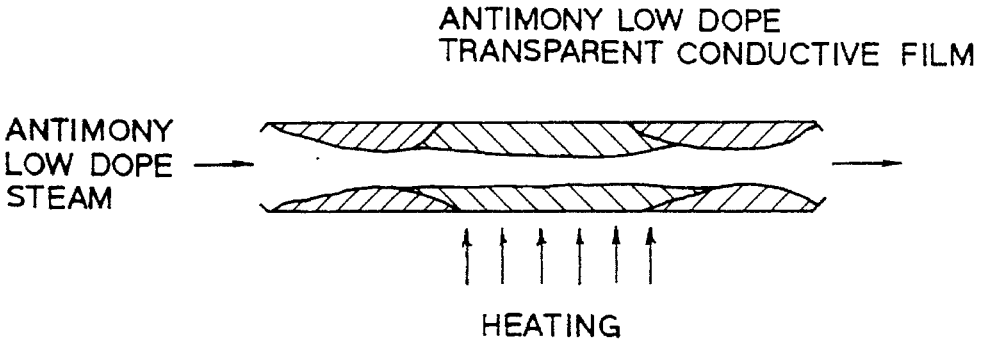

Thereafter, as shown in FIG. 7B, while only the central portion of the bulb 1 is heated in the heating oven at a temperature of about 580° C., the mixed vapors of tin tetrachloride and antimony trichloride are introduced into the glass bulb 1 from one end opening thereof with a molar ratio of, for example, about 99.5:0.5 to form a transparent conductive film, including the antimony content of 0.5%, at the central portion of the bulb 1.

According to the processes described above, the transparent conductive film of the present embodiment can be formed in which the end portions of the bulb has the antimony content of 1.5% and the central portion thereof has the the antimony content of 0.5%. The fluorescent lamp having the transparent conductive film manufactured of this process attains substantially the same functions and effects as described above with reference to FIG. 2.

Furthermore, according to a low-pressure mercury vapor discharge lamp of a further embodiment, in which FIGS. 1 to 3 are commonly applied, in comparison of the fluorescent lamp A' of the present invention having a thin transparent conductive film with a fluorescent lamp B' of conventional structure having a thick transparent conductive film having a central portion of the thickness of about 120 nm, at a time when they were lightened, the blackening phenomenon was visually observed after the lighting time of about 1500 hours with respect to the lamp A' but such blacking phenomenon was visually observed after the lighting time of about 1000 hours with respect to the lamp B'. Further, in comparison of the starting voltage between these fluorescent lamps A' and B', there was substantially no difference in the startability just after the production thereof, but after the lighting time of about 1000 hours, the fluorescent lamp A' of the present embodiment provided an excellent startability in comparison with the fluorescent lamp B'.

The transparent conductive film 4 of the present embodiment contains antimony of the concentration of 0.7 to 2.0 mol %, which is determined by most suitable ranges of the degree of the resistance of the transparent conductive film in the elapsed time due to antimony concentration, the coloring degree (full-light transmittance) of the transparent conductive film and the value of the resistance. This is of course mentioned to a case of the transparent conductive film having a fine (microscopic) structure including less residual of the undecomposed tin compound. This will be explained hereunder with reference to FIG. 8.

Figure 8:
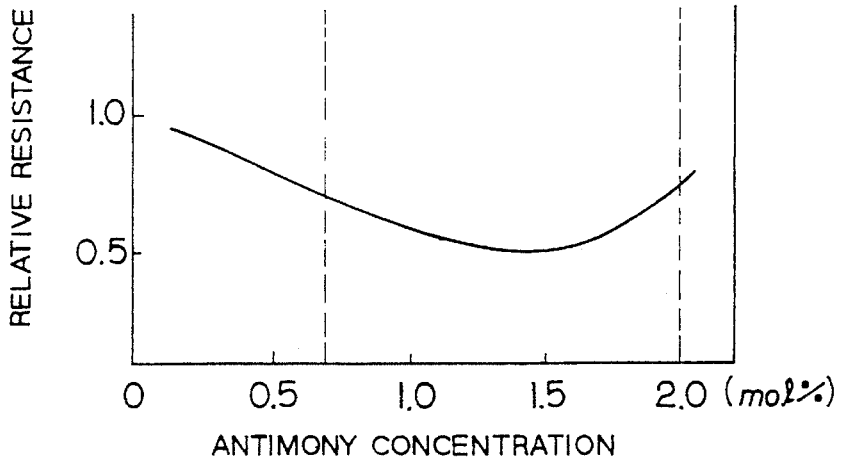
FIG. 8 is a graph showing a relationship between antimony concentration and relative resistance of a transparent conductive film of a low-pressure mercury vapor discharge lamp of further embodiment of the present invention.

FIG. 8 is a graph representing a relationship between the antimony concentration and the relative resistance of the transparent conductive film, in which the relative resistance is made to a value 1.0 at a time of zero (0) antimony concentration. At this time, the relative resistance decreases in accordance with the increasing of the antimony concentration and then increases when the antimony concentration reaches 1.5 mol % being the lowest value thereof.

Figure 9:
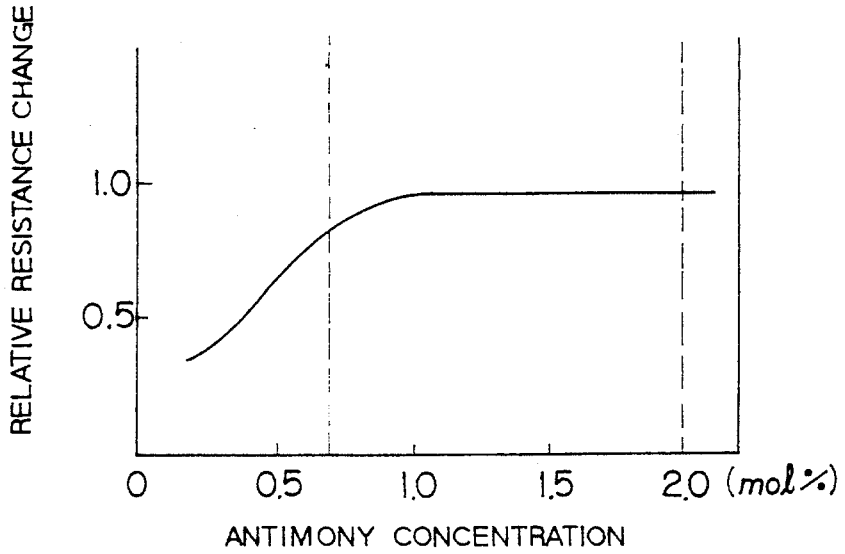
FIG. 9 is a graph showing a relationship between antimony concentration and relative resistance change of a transparent conductive film of a low-pressure mercury vapor discharge lamp of further embodiment of the present invention.

FIG. 9 is a graph representing the degree of change of resistance in an elapsed time, in which the resistance of the conductive film after the lighting time of 100 hours is made to a value 1.0. At this time, the resistance after the lighting time of about 1000 hours approaches the value of 1.0 in accordance with the increasing of the antimony concentration and the resistance does not substantially changes in the case of the antimony concentration more than 0.7 mol %. In a case where the transparent conductive film is not minutely formed, the resistance varies largely and is not stabilized even in case of high antimony concentration.

Figure 10:
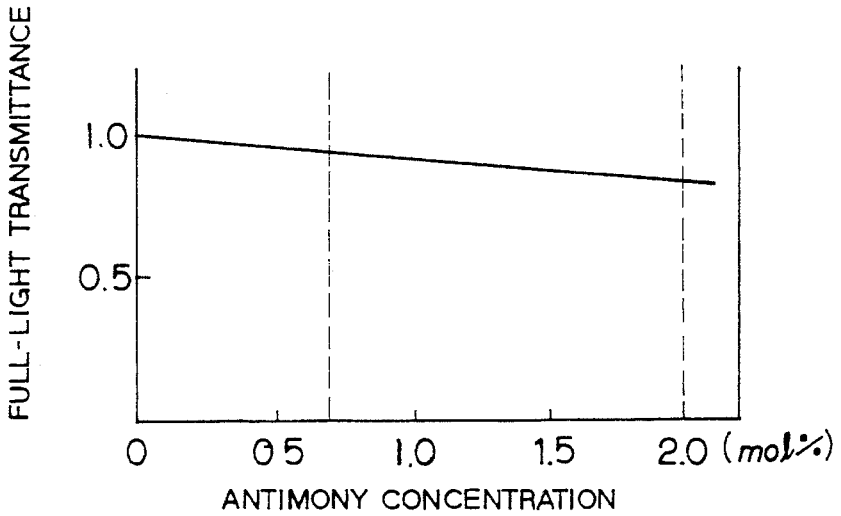
FIG. 10 is a graph showing a relationship between antimony concentration and full-light transmittance of a transparent conductive film of a low-pressure mercury vapor discharge lamp of the further embodiment of the present invention.

FIG. 10 is a graph representing the degree of coloring (full-light transmittance) of the transparent conductive film 4, and as shown in FIG. 10, it gradually decreases in accordance with the increasing of the antimony concentration. As most applicable ranges of these characteristic values of the coloring degrees, ranges more than 0.7 mol % and less than 2.0 mol % will be selectively adapted. That is, in the cases of more than 0.7 mol % and less than 2.0 mol %, the resistance less varies in the elapsed time and the transparent conductive film is less colored, thus highly maintaining the light transmittance and being capable of making thick the thickness of the conductive film for achieving a constant conductivity with low resistance.

An experiment was performed for investigating the relationship between the thickness of the transparent conductive film 4 and the blackening generation rate after the lighting time of about 5000 hours. Such test results are shown in FIG. 11, in which the coordinate axis represents the ratio of the test lamps subjected to the causing of the blackening phenomenon.

Figure 11:
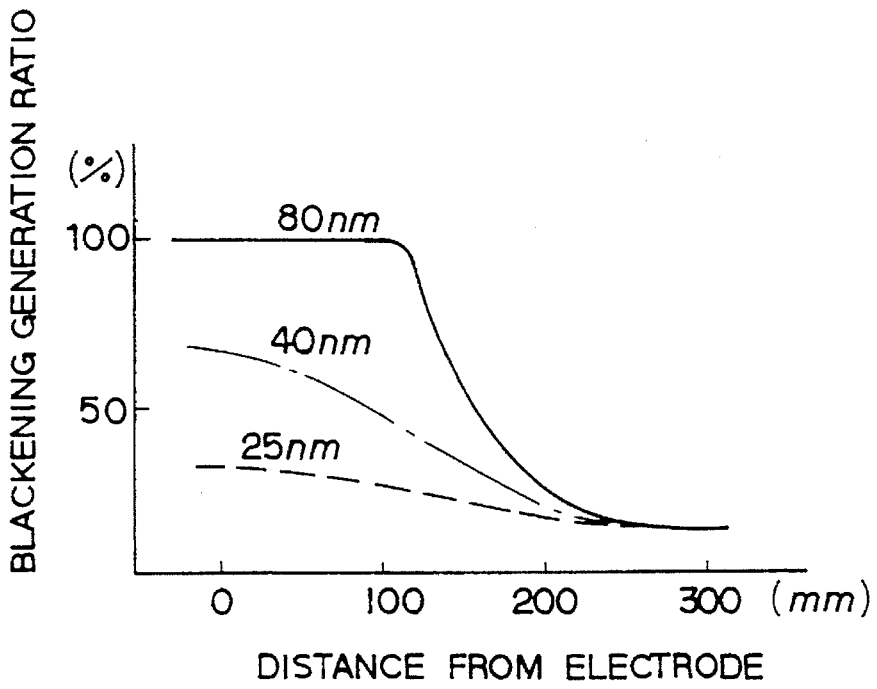
FIG. 11 is a graph showing a relationship between a film thickness of a transparent conductive film of a low-pressure mercury vapor discharge lamp of the further embodiment of the present invention and a generation of the blackening to the bulb of the discharge lamp after the lighting time of 5000 hour at various portions from electrodes.

As shown in FIG. 11, the blackening generation ratio near the electrodes varies at portions of the conductive film from electrodes, i.e. the ends of the bulb, to portions of about 20 cm apart from the electrodes in accordance with the thickness of the transparent conductive film. However, the low blackening generation ratio is observed at portions apart, inwardly of the bulb, from the 20 cm portions form the electrodes not depending on the thickness of the transparent conductive film. According to the above facts, it will be found that the blackening generation ratio can be lowered at the portions of the bulb in the vicinity of the electrodes by forming the transparent conductive film with thin thickness at portions from the electrodes to the portions apart therefrom by for example about 20 cm without the thickness of the central portion of the bulb. It will be also observed that the blackening generation ratio is also made relatively low with the thickness of less than 25 nm. In such case, the condition of the conductive film is intentionally changed so as not to change the resistance even when the thickness of the conductive film differs.

Figure 12:
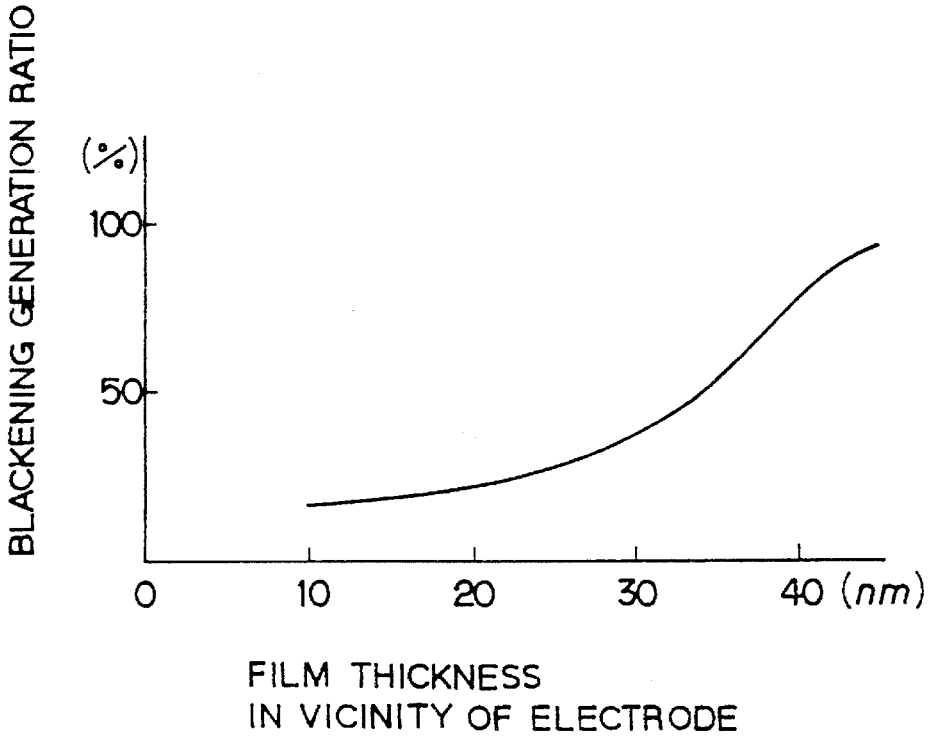
FIG. 12 is a graph showing a relationship between an average film thickness, at a portion near the electrode, of a transparent conductive film of a low-pressure mercury vapor discharge lamp of the further embodiment of the present invention and a generation of the blackening to the bulb of the discharge lamp after the lighting time of 5000 hour at various portions from electrodes.

FIG. 12 is a graph representing a relationship, obtained through experiments, between the average film thickness of the transparent conductive film at portions in the vicinity of the electrodes, i.e. portions inwardly apart by about 20 cm from the electrodes, and the blackening generation ratio at these portions after the lighting time of about 5000 hours, and in this case, the resistance is made equal throughout these portions. As can be seen from the characteristic features of FIG. 12, the blackening generation ratio becomes smaller as the film structure of the transparent conductive film is formed more thin and fine.

As described above, according to the fluorescent lamp of this embodiment, the blacking generation ratio can be made small by forming the transparent conductive film with thin thickness, and this thickness can be made small by lowering the resistance by selecting the antimony concentration to a range between 0.7 to 2.0 mol %, thus easily reducing the blackening generation ratio. Furthermore, according to this embodiment, since the resistance change of the transparent conductive film can be made small, the generation of the blackening phenomenon can be suppressed or controlled for a long time use. The antimony concentration within 0.7 to 2.0 mol % allows the transparent conductive film to maintain high light transmittance.

In the embodiments described above, Xe gas may be utilized in substitution for the mercury gas, and the Xe gas discharges a strong ultraviolet rays, which largely varies the electric resistance of the transparent conductive film.

Accordingly, a microscopic discharge is caused at a portion near the electrode, which may cause various adverse reactions to the phosphor film and the glass bulb due to the microscopic discharge, which can be suppressed by the present invention.

Furthermore, the transparent conductive film may be formed by other methods such as spraying method.

Similar effects and advantages to those described above will be achieved even if the resistance distribution of the transparent conductive film does not provide an ideal V-shape.

According to the embodiments of the present invention described above, the transparent conductive film having high ultraviolet ray decreasing performance is formed to the portion at which the resistance thereof likely varies, so that the resistance distribution is bilaterally balanced, thus eliminating the generation of the blackening phenomenon during the long time use of the discharge lamp with high quality.

Since tin oxide as the main component of the transparent conductive film and antimony as the additive therefor are combined in use, thus realizing the low-pressure mercury vapor discharge lamp of high reliability with high quality.

The generation of the blackening phenomenon can be eliminated by making thin the transparent conductive film thickness by specially defining the content of the antimony to be added with high quality and high light transmittance for a long time use of the lamp.

What is claimed is:

1. A low-pressure mercury vapor discharge lamp comprising:

a light-transmitting tube containing a discharge medium and having longitudinal end portions;

a pair of discharge electrodes each mounted in a vicinity of the respective end portions of the tube;

a transparent conductive film formed of metallic oxide as a main component thereof and coated on an inner surface of the light-transmitting tube between the discharge electrodes, said transparent conductive film having a thickness at one end portion of the tube thinner than a thickness of the transparent conductive film at the other end portion of the tube; and a phosphor film coated on the transparent conductive film, said phosphor film having a thickness at said one end portion of the tube thinner than a thickness of the phosphor film at said other end portion of the tube.

2. A low-pressure mercury vapor discharge lamp comprising:

a light-transmitting tube containing a discharge medium and having longitudinal end portions;

a pair of discharge electrodes each mounted in a vicinity of the respective end of the tube;

a transparent conductive film formed of metallic oxide as a main component thereof and coated on an inner surface of the light-transmitting tube between the discharge electrodes, said transparent conductive film having a thickness at one end portion of the tube thinner than a thickness of the transparent conductive film at the other end portion of the tube;

an ultraviolet decreasing film coated on the transparent conductive film; and a phosphor film coated on the ultraviolet decreasing film, wherein a combined thickness of the ultraviolet decreasing film and the phosphor film at said one end portion of the tube is thinner than a combined thickness of the ultraviolet decreasing film and the phosphor film at said other end portion of the tube.

3. A low-pressure mercury vapor discharge lamp comprising:

a light-transmitting tube containing a discharge medium and having longitudinal end portions;

a pair of discharge electrodes each mounted in a vicinity of the respective end portions of the tube;

a transparent conductive film formed of metallic oxide as a main component thereof with a small quantity of an additive and coated on an inner surface of the light-transmitting tube between the discharge electrodes, wherein a content of the additive in the transparent conductive film at one end portion of the tube is greater than a content of the additive in the transparent conductive film at the other end portion of the tube; and a phosphor film coated on the transparent conductive film, said phosphor film having a thickness at said one end portion of the tube thinner than a thickness of the phosphor film at said other end portion not the tube.

4. A low-pressure mercury vapor discharge lamp comprising:

a light-transmitting tube containing a discharge medium and having longitudinal end portions;

a pair of discharge electrodes each mounted in a vicinity of the respective end portions of the tube;

a transparent conductive film formed of metallic oxide as a main component thereof and coated on the inner surface of the light-transmitting tube between the discharge electrodes, wherein said transparent conductive film has a thickness at one end portion of the tube thinner than a thickness of the transparent conductive film at the other end portion of the tube and has a thickness at a middle portion of the tube thicker than the thicknesses of the transparent conductive film at either end portion of the tube; and a phosphor film coated on the transparent conductive film, wherein the phosphor film has a thickness at said one end portion of the tube thinner than a thickness at said other end portion of the tube and has a thickness gradually increasing from said one end portion to said other end portion of the tube.

5. A low-pressure mercury vapor discharge lamp comprising:

a light-transmitting tube containing discharge medium and having longitudinal end portions;

a pair of discharge electrodes each mounted in a vicinity of the respective end portions of the tube;

a transparent conductive film coated on an inner surface of the light-transmitting tube between the discharge electrodes, wherein a stability of an electrical resistance of the transparent conductive film is lower at one end portion than at the other end portion of the tube; and an ultraviolet decreasing film coated on the transparent conductive film, said ultraviolet decreasing film having a higher ultraviolet decreasing capability at one end portion than at the other end portion of the tube.

6. A low-pressure mercury vapor discharge lamp according to any one of claims 1 to 5, wherein said transparent conductive film has a central portion which has a thickness larger than a thickness at either end portion thereof.

7. A low-pressure mercury vapor discharge lamp according to any one of claims 1 to 5, wherein said transparent conductive film has a central portion which has an electric resistance smaller than that at either end portion thereof.

8. A low pressure mecury vapor discharge lamp according to any one of claims 1 to 5, wherein said transparent conductive film has a maximum thickness equal to or less than 100 nm.

9. A low-pressure mercury vapor discharge lamp comprising:

a light-transmitting tube containing discharge medium and having longitudinal end portions;

a pair of discharge electrodes each mounted in a vicinity of the respective end portions of the tube;

a transparent conductive film formed of a tin oxide as a main component thereof and coated on an inner surface of the light-transmitting tube between the discharge electrodes, said transparent conductive film including an antimony a concentration of which is in the range of 0.8 to 2.0 mol % at both the end portions of the tube and the concentration of which is in the range of 0.2 to 1.0 mol % at a central portion thereof, and an electric resistance at both the end portions of the tube is made higher than that at the central portion thereof.

10. A low-pressure mercury vapor discharge lamp comprising:

a light-transmitting tube containing discharge medium and having longitudinal end portions;

a pair of discharge electrodes each mounted in a vicinity of the respective end portions of the tube;

a transparent conductive film formed of a tin oxide as a main component thereof and coated on an inner surface of the light-transmitting tube between the discharge electrodes, said transparent conductive film including an antimony a concentration of which is in the range of 0.8 to 2.0 mol % at both the end portions of the tube and the concentration of which is in the range of 0.2 to 1.0 mol % at a central portion thereof, and an electric resistance at both the end portion of the tube is made higher than that at the central portion thereof; and a phosphor film coated on in inside surface of the transparent conductive film inside the tube.

11. A low-pressure mercury vapor discharge lamp according to claim 9 or 10, wherein said transparent conductive film has a thickness at both the end portions of the tube thinner than that at the central portion thereof.

12. A low-pressure mercury vapor discharge container according to claim 9 or 10, wherein the thickness of the transparent conductive film at each of both the end portions of the tube is equal to or less than 25 nm.

13. A low-pressure mercury vapor discharge lamp comprising:

a light-transmitting tube containing discharge medium and having longitudinal end portions;

a pair of discharge electrodes each mounted in a vicinity of the respective end portions of the tube; and a transparent conductive film formed of metallic oxide mainly containing tin oxide including antimony of 0.7 to 2.0 mol % and coated on an inner surface of the tube between the electrodes, wherein said transparent conductive film has a central portion having a thickness equal to or less than 100 nm and both end portions each having a thickness equal to or less than 25 nm and wherein the central portion of said transparent conductive film has the thickness thicker than that of each of the end portions and the transparent conductive film has a resistance of 2 kΩ to 50 kΩ per 10 cm of a longitudinal length of the tube at the central portion thereof and a resistance of 20 kΩ to 1000 kΩ per 10 cm of the longitudinal length of the tube at each of the end portions thereof.

14. A low-pressure mercury vapor discharge lamp comprising:

a light-transmitting tube containing discharge medium and having longitudinal end portions;

a pair of discharge electrodes each mounted in a vicinity of the respective end portions of the tube; and a transparent conductive film formed of metallic oxide mainly containing tin oxide including antimony of 0.7 to 2.0 mol % and coated on an inner surface of the tube between the electrodes, wherein said transparent conductive film has a central portion having a thickness equal to or less than 100 nm and both end portions each having a thickness equal to or less than 25 nm and wherein the central portion of said transparent conductive film has the thickness larger than that of each of the end portions and the transparent conductive film has a resistance of 2 kΩ to 50 kΩ per 10 cm of a longitudinal length of the tube at the central portion thereof and a resistance of 20 kΩ to 1000 kΩ per 10 cm of the longitudinal length of the tube at each of the end portions thereof; and a phosphor film formed on an inside surface of said transparent conductive film.

15. A low-pressure mecury vapor type discharge lamp according to claim 14, wherein the central portion of the transparent conductive film of the container has a resistance higher than that of each of the end portions thereof.

16. An illuminating apparatus according to any of claims 1–5, 9–10, or 13–14, comprising:

a main illuminating unit;

a low-pressure mercury vapor discharge lamp attached to the main illuminating unit; and a discharge lamp lighting device mounted on the main illuminating unit for driving the low-pressure mercury vapor discharge lamp.

* * * * *